US005856055A

United States Patent [19]

Ugai et al.

[11] Patent Number: 5,856,055

[45] Date of Patent: Jan. 5, 1999

[54] TONER FOR DEVELOPING ELECTROSTATIC IMAGES AND PROCESS FOR PRODUCTION THEREOF

[75] Inventors: Toshiyuki Ugai, Tokyo; Kazumi Yoshizaki, Mishima, both of Japan

[73] Assignee: Canon Kabushiki Kaisha, Tokyo, Japan

[21] Appl. No.: 50,467

[22] Filed: Mar. 31, 1998

[30] Foreign Application Priority Data

Apr. 4, 1997 [JP] Japan ..... 9-086167

[51] Int. Cl.[6] ..... G03G 9/09

[52] U.S. Cl. ..... 430/106; 430/110; 430/137

[58] Field of Search ..... 430/106, 110, 430/137

[56] References Cited

U.S. PATENT DOCUMENTS

| | | | |
|---|---|---|---|
| 4,206,064 | 6/1980 | Kiuchi et al. | 430/106 |
| 5,439,770 | 8/1995 | Taya et al. | 430/106 |
| 5,451,482 | 9/1995 | Law et al. | 430/110 |

FOREIGN PATENT DOCUMENTS

| | | | |
|---|---|---|---|
| 0251326 | 1/1988 | European Pat. Off. | 430/106 |
| 57-130045 | 8/1982 | Japan | 430/106 |
| 59-50449 | 3/1984 | Japan | 430/106 |
| 59-78362 | 5/1984 | Japan | 430/106 |

*Primary Examiner*—Roland Martin
*Attorney, Agent, or Firm*—Fitzpatrick, Cella, Harper & Scinto

[57] ABSTRACT

An electrophotographic black toner containing carbon black in a good dispersion state as well as a combined charge control agent system including a specific azo iron metal compound of formula (1) shown below and an oxycarboxylic acid metal compound is produced through polymerization in an aqueous system. The combined charge control agent system shows an effects of synergistically improving the chargeability of spherical polymerized toner particles. The azo iron metal compound improves the dispersion of the carbon black in the toner particles.

(1)

wherein the denotations of $R_1$–$R_6$, n, n' and $A^{\oplus}$ are omitted.

38 Claims, 3 Drawing Sheets

TONER FOR DEVELOPING ELECTROSTATIC IMAGES AND PROCESS FOR PRODUCTION THEREOF

FIELD OF THE INVENTION AND RELATED ART

The present invention relates to a toner for developing electrostatic images used in electrophotography, etc., and a process for producing such a toner.

Hitherto, a large number of electrophotographic processes have been known. In these processes, an electric latent image is generally formed on an image-bearing member (photosensitive member) comprising a photoconductive material by various means, then the latent image is developed and visualized with a toner, and the resultant toner image is, after being transferred onto a transfer (-receiving) material, such as paper, as desired, fixed by heating and/or pressing, etc., to obtain a copy or a print.

As for printing apparatus, LED printers and LBP printers are principally adopted as complying with the demand on the market and, for these printers, higher resolution of 400, 600 and 1200 dpi are required compared with conventional levels of 240–300 dpi. Accordingly, the developing scheme therefor is also required to show a higher resolution. Also in the copying apparatus, higher performances are required, and a principal demand is directed to a digital image forming technique as a trend. The digital image formation principally involves the use of a laser for forming electrostatic images for which a higher resolution is intended. Thus, similarly as in the printer, a developing scheme of a higher resolution and a higher definition is demanded. For complying with these demands, the use of smaller size toners is becoming popular, and such small particle size toners having a specific particle size distribution have been proposed in, e.g., Japanese Laid-Open Patent Application (JP-A) 1-112253, JP-A 1-191156, JP-A 2-214156, JP-A 2-284158, JP-A 3-181952 and JP-A 4-162048.

A toner image formed on a photosensitive member in the developing step is transferred onto a transfer material in the transfer step, and a transfer-residual toner remaining on the photosensitive member is cleaned in a cleaning step to be recovered in a waste toner vessel. In the cleaning step, a blade cleaner, a fur brush cleaner, a roller cleaner, etc., have been conventionally used. From the viewpoint of an apparatus size, the entire image forming apparatus size is necessarily increased because of inclusion of such a cleaning device, and this has provided an obstacle to provide a reduction in entire apparatus size. Further, from the viewpoints of ecology and effective toner utilization, an image forming system resulting in less waste toner, and a toner showing a good transfer efficiency, and desired.

For the above reason, various trials have been made for improving the transferability of a toner. As an example of such trials, it has been tried to increase the sphericity and surface smoothness of a toner, thereby reducing the frictional force acting between the photosensitive member and the cleaner member and providing an elongated life of the photosensitive member. As a result of these factors, it has been tried to reduce the contact area between the toner and the photosensitive member and reduce the attachment force of the toner acting onto the photosensitive member, thereby increasing the transfer efficiency.

As a process for producing such a spherical and surface-smooth toner, a polymerization process may be cited. In the conventional toner production through the pulverization process, a melt-kneaded toner composition under heating is cooled and then pulverized and, because of the pulverization step, the resultant toner particles are caused to have indefinite shapes and uneven surfaces. In contrast thereto, in the toner production through the polymerization process proposed in Japanese Patent Publication (JP-B) 36-10231, toner particles are directly produced by suspension polymerization, so that it is possible to obtain spherical and surface-smooth toner particles.

However, such spherical and smooth toner particles are caused to have a smaller contact area with the charging member because of their sphericity and smoothness, so that they are liable to suffer from a remarkably lower chargeability in a high humidity environment. For alleviating this difficulty, it is necessary to provide a toner material having a better chargeability than a conventional toner level.

A toner can be provided with a charge by using the triboelectric chargeability of a resin as a toner component but the chargeability obtained only by this measure is low, so that the toner is liable to result in foggy and unclear images. Accordingly, in order to provide a toner with a desired triboelectric chargeability, it has been practiced to add a chargeability-imparting dye or pigment, and further a charge control agent.

A toner containing a charge control agent is liable to soil a toner-carrying member, such as a developing sleeve, so that the triboelectric charge provided to the toner is liable to be lowered as the number of image formation increases, thus resulting in a lowering in image density. Further, a certain type of charge control agent has an insufficient triboelectric chargeability-imparting effect and is liable to be affected by temperature or humidity, thus being liable to cause a fluctuation in image density due to changes in environmental conditions. Also, a certain type of charge control agent has a poor dispersibility in resin, so that the resultant toner is liable to have ununiform triboelectric charges among individual toner particles, thus resulting in foggy images. Further, a certain charge control agent has a poor storage stability, and the resultant toner is liable to cause a lowering in triboelectric chargeability during a long period of storage.

Examples of negative chargeability-imparting charge control agents known at present may include: metal complex salts of monoazo dyes; metal complex salts of salicylic acids, naphthoic acids and dicarboxylic acids; copper phthalocyanine pigment, and resins containing acid components. On the other hand, examples of positive chargeability-imparting agents may include: nigrosin dyes, azine dyes, triphenylmethane dyes, quaternary ammonium salts, and resins having a branch of quaternary ammonium salt.

Particularly, various metal complexes have been proposed as negative charge control agents, e.g., by JP-B 43-17955, JP-B 55-42752, JP-A 61-155464, JP-B 63-1994 and JP-A 8-272146. These metal complexes actually exhibit good chargeability-imparting performances, which however are not sufficient for spherical and smooth toner particles as described above, thus leaving a room for improvement, as a result of our study.

On the other hand, the poor dispersibility of carbon black has been problematic, and the problem is more serious in toner production according to the polymerization process, so that an improvement has been desired also in this respect.

SUMMARY OF THE INVENTION

A generic object of the present invention is to provide a toner for developing electrostatic images having solved the above-mentioned problems.

A more specific object of the present invention is to provide a toner for developing electrostatic images having excellent transferability.

Another object of the present invention is to provide a toner for developing electrostatic images exhibiting good chargeability in various environments including high temperature/high humidity environment and low temperature/low humidity environment.

Another object of the present invention is to provide a toner for developing electrostatic images, capable of providing high-quality images continually for a long period.

A further object of the present invention is to provide a process for suitably producing such a toner.

According to the present invention, there is provided a toner for developing electrostatic images, comprising toner particles containing a binder resin, carbon black, an azo iron compound represented by formula (1) below, and an oxycarboxylic acid metal compound, wherein the toner particles have been prepared by:

preparing a polymerizable monomer composition comprising a polymerizable monomer, carbon black, an azo iron compound represented by the formula (1) below and an oxycarboxylic acid metal compound, dispersing the polymerizable monomer composition in an aqueous medium to form particles of the polymerizable monomer composition, and polymerizing the polymerizable monomer in the particles to form toner particles comprising the polymerized monomer as the binder resin;

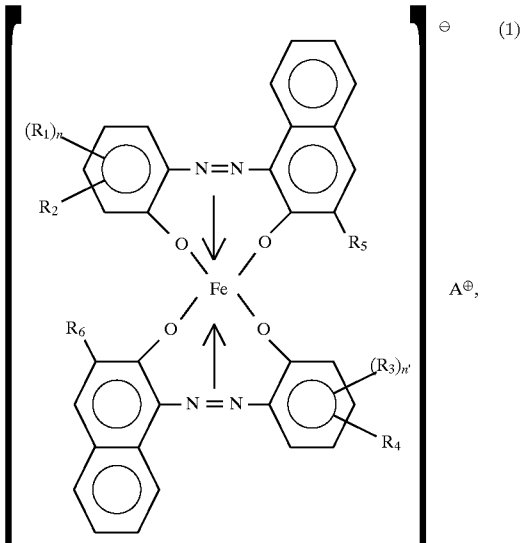

wherein $R_1$ and $R_3$ independently denote hydrogen, $C_{1-18}$ alkyl, $C_{2-18}$ alkenyl, sulfonamido group, mesyl, sulfonic acid group, hydroxy, $C_{1-18}$ alkoxy, acetylamino, benzoylamino, halogen atom, or —O.CO.$R_7$ wherein $R_7$ is alkyl or aryl, n and n' are integers of 1–3, $R_2$ and $R_4$ independently denote hydrogen or nitro, $R_5$ and $R_6$ independently denote hydrogen, halogen, nitro, carboxy, $C_{1-18}$ alkyl, $C_{-18}$ alkenyl, $C_{7-18}$ aralkyl, $C_{1-18}$ alkoxy, $C_{6-18}$aryl, —O.CO.$R_7$ wherein $R_7$ is $C_{1-18}$ alkyl or $C_{6-18}$ aryl, or

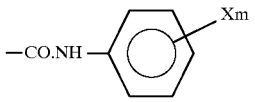

wherein m is an integer of 1–3 and X denotes hydrogen, lower alkyl, lower alkoxy, nitro or halogen; and $A^{\oplus}$ denotes $H^+$, $Na^+$, $K^+$, $NH_4^+$ or a mixture of these ions.

According to another aspect of the present invention, there is provided a process for producing a toner for developing electrostatic images, comprising the steps of:

(i) preparing a polymerizable monomer composition comprising a polymerizable monomer, carbon black, an azo iron compound represented by the abovementioned formula (1) and an oxycarboxylic acid metal compound, (ii) dispersing the polymerizable monomer composition in an aqueous medium to form particles of the polymerizable monomer composition, and (iii) polymerizing the polymerizable monomer in the particles to form toner particles comprising the polymerized monomer as a binder resin.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
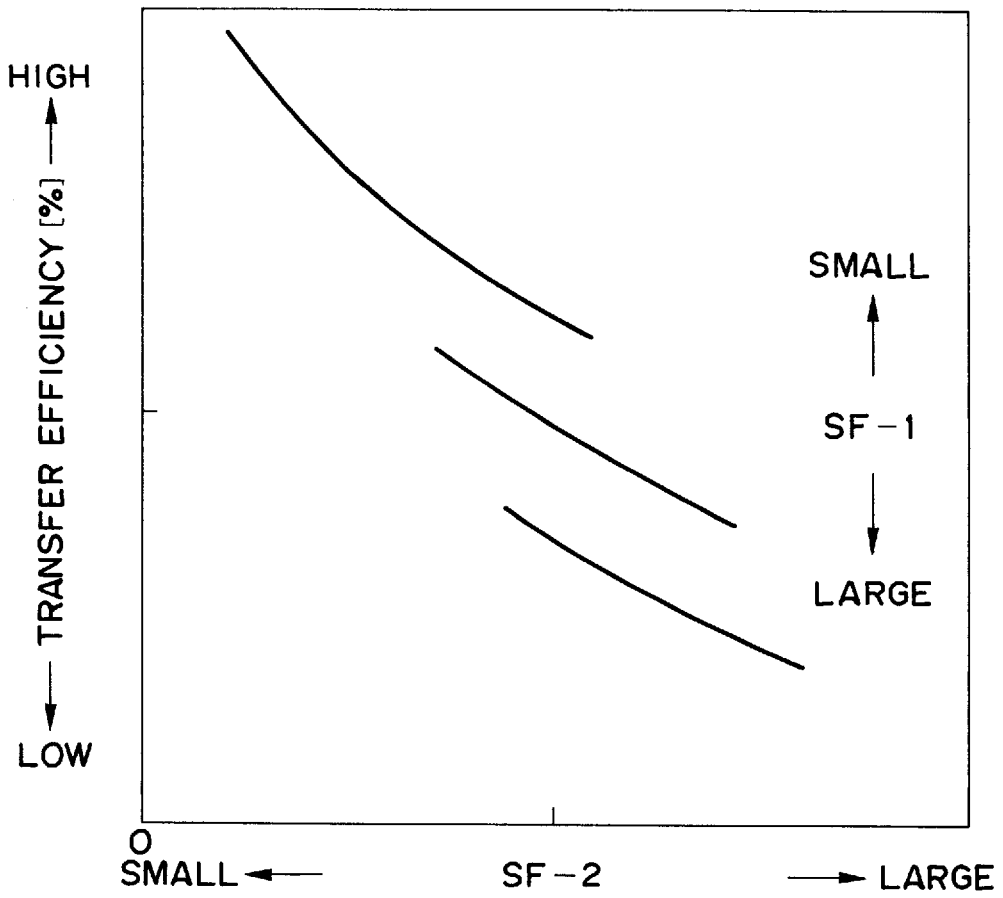
FIG. 1 is a graphic illustration of a relationship between a transfer efficiency and shape factors of a toner.

As described above, toner particles having a spherical shape and a smooth surface are liable to show a lower chargeability in a high humidity environment, thus being liable to provide images accompanied with toner scattering or fog. On the other hand, if the chargeability is increased in order to solve the problem, the resultant toner is liable to be excessively charged in a low humidity environment, thus resulting in images of a lower image density and a lowering in transfer efficiency.

We have solved the above problems by using a specific azo iron compound and an oxycarboxylic acid metal compound in combination.

A developer containing an organic acid metal compound generally used as a charge control agent can exhibit a relatively high chargeability in some cases but is liable to exhibit a lowering in chargeability in a high humidity environment and a lowering in charging speed in a low humidity environment.

As a cause for the above phenomenon, the adsorption and desorption of moisture to a site close to the metal may be conceived. More specifically, it is assumed that the adsorbed moisture onto the metal compound is increased to result in a lower chargeability in a high humidity environment, and the adsorbed moisture is decreased to result in a higher resistivity leading to a lower charging speed in a low humidity environment.

In contrast thereto, in the case of using a developer containing an oxycarboxylic acid which is assumed to have a low negative charge density on the carboxylic group oxygen among the organic acids, it is possible to attain a high chargeability. This is presumably because, in the case of a low negative charge density on the carboxylic group oxygen, the electron density on the metal bonded thereto is not increased so much, and the metal compound can exhibit a high negative chargeability.

An aromatic oxycarboxylic acid has been found to exhibit a particularly high effect. The reason for this is not clear as yet but may be attributable to factors such that an aromatic oxycarboxylic acid has a resonance structure to provide a lower negative charge density on the carboxylic oxygen and a stereoscopically large structure suitable for blocking water molecules from the bonded metal atoms.

Incidentally, several developers containing oxycarboxylic acid metal compounds have been proposed, including a salicylic acid chromium compound in JP-B 55-42752, salicylic acid zinc compounds in JP-A 63-2074 and JP-A 63-33755, and salicylic acid aluminum compounds in JP-A 63-208865, JP-A 63-237065 and JP-A 64-10261.

According to our study, however, an oxycarboxylic acid metal compound alone, when used in a spherical and smooth-surfaced toner as contemplated in the present invention, provides a toner showing a slow charging speed leading to a large difference in charge at an initial stage and a steady state in a continuous image formation, and a lowering in image density.

As a result of further study for solving the problem, we have found a solution that the co-use of an azo iron compound can prevent the lowering in charging speed in a low humidity environment and further provide an improved chargeability in a high humidity environment.

On the other hand, the use of an azo iron compound alone as a charge control agent, can provide a good charging speed free from the difficulty due to a low charge at the start--up, but the chargeability level in the steady state is low, thus being liable to result in toner scattering and fog in a low humidity environment.

As a result of our study, however, it has been found that the use of a specific azo iron compound and an oxycarboxylic acid metal compound in combination provides an effect which is larger than the sum of effects obtained by the use of the respective compounds alone, thus being able to provide a remarkably improved chargeability in various environments.

The reason for the above improvement is not clear as yet, but it is assumed that the co-use of these compounds allows better mutual dispersion of the respective compounds leading to more effective performances and better environmental characteristics.

The toner composition of the present invention exhibits a great effect for a spherical and smooth-surfaced toner containing carbon black as a colorant formed through the polymerization process and allows such a toner to exhibit a remarkably enhanced chargeability in a high humidity environment.

The reason for this improvement is not yet clear but may be attributable to a remarkably improved dispersibility of carbon black due to the co-inclusion of the azo iron compound in a polymerizable monomer composition. As a result, in the resultant toner particle, the formation of a conductive path due to insufficient dispersion of electroconductive carbon black is suppressed, and the exposure of the carbon black to the toner particle surfaces is suppressed to result in a suppressed charge leakage and an increased chargeability.

As a result of further study of ours, it has been found preferable to add the azo iron compound and the oxycarboxylic acid metal compound in amounts of A wt. parts and B wt. parts, respectively, satisfying the condition of $0.1 \leqq A/B \leqq 20$. This condition is preferred in order to ensure the effect of combined use discussed above. Outside the range, there result in inferior charging speed at a start-up in a low humidity environment and a lowering in chargeability in a high humidity environment which may be attributable to a change in state of dispersion of the respective compounds, thus failing to attain the above-mentioned synergistic effect.

The azo iron compound used in the present invention has a structure represented by the following formula (1):

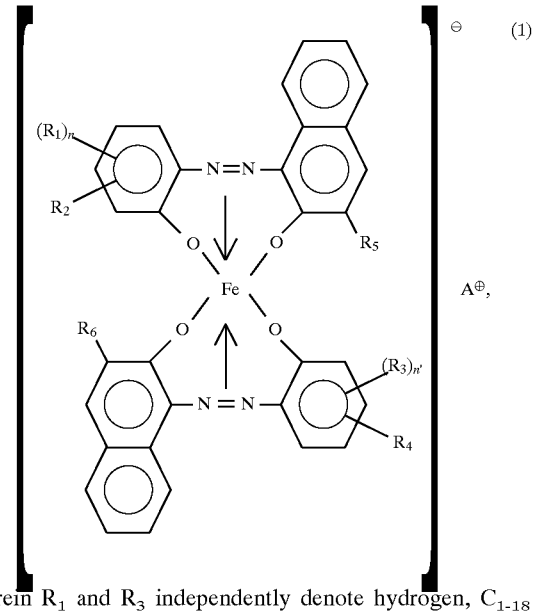

(1)

wherein $R_1$ and $R_3$ independently denote hydrogen, $C_{1-18}$ alkyl, $C_{2-18}$ alkenyl, sulfonamido group, mesyl, sulfonic acid group, hydroxy, $C_{1-18}$ alkoxy, acetylamino, benzoylamino, halogen atom, or —O.CO.$R_7$ wherein $R_7$ is $C_{1-18}$ alkyl or $C_{6-18}$ aryl, n and n' are integers of 1–3, $R_2$ and $R_4$ independently denote hydrogen or nitro, $R_5$ and $R_6$ independently denote hydrogen, halogen, nitro, carboxy, $C_{1-18}$ alkyl, $C_{2-18}$ alkenyl, $C_{7-18}$ aralkyl, $C_{1-18}$ alkoxy, $C_{6-18}$ aryl each having up to 18 carbon atoms; —O.CO.$R^7$ wherein $R_7$ is alkyl or aryl, or

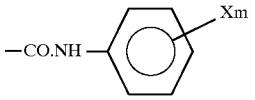

wherein m is an integer of 1–3 and X denotes hydrogen, lower alkyl, lower alkoxy, nitro or halogen; and $A^{\oplus}$ denotes $H^+$, $Na^+$, $K^+$, $NH_4^+$ or a mixture of these ions. Herein, lower alkyl and lower alkoxy mean an alkyl group and an alkoxy group, respectively, having at most 5 carbon atoms (i.e., of $C_1$ –$C_5$).

A preferred class of azo iron compounds used in the present invention may have a structure represented by the following formula (2):

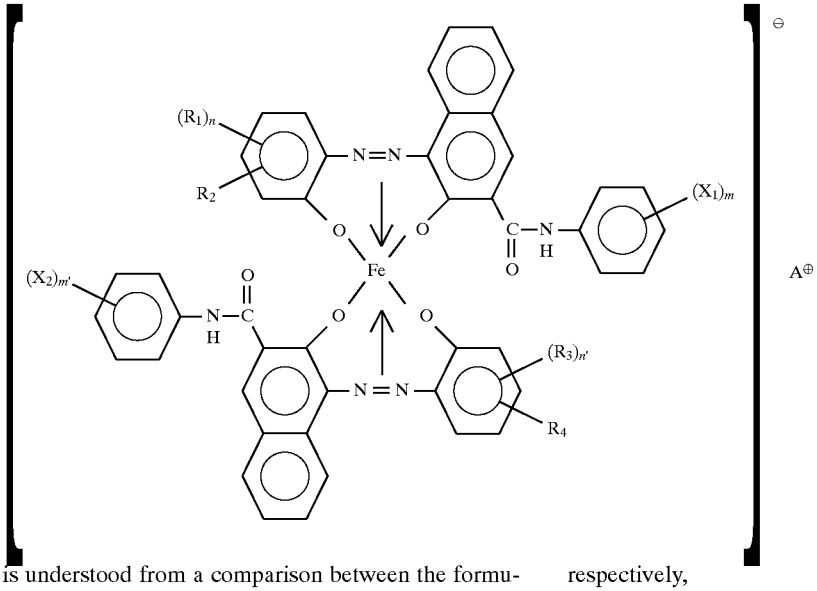

(2)

As is understood from a comparison between the formulae (1) and (2), the formula (2) is obtained by replacing the groups $R_5$ and $R_6$ in the formula (1) with the following formulae of groups:

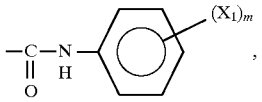

and

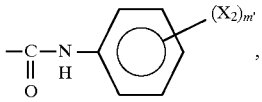

respectively, wherein $X_1$ and $X_2$ independently denote hydrogen, lower alkyl, lower alkoxy, nitro or halogen; and m and m' re integers of 1–3.

In the formula (2), $R_1$ –$R_4$, n, n' and $A^+$ are the same as in the formula (1).

Specific examples of the azo iron compound preferably used in the present invention may include the following Azo iron compounds (1)–(6):

Azo iron compound (1):

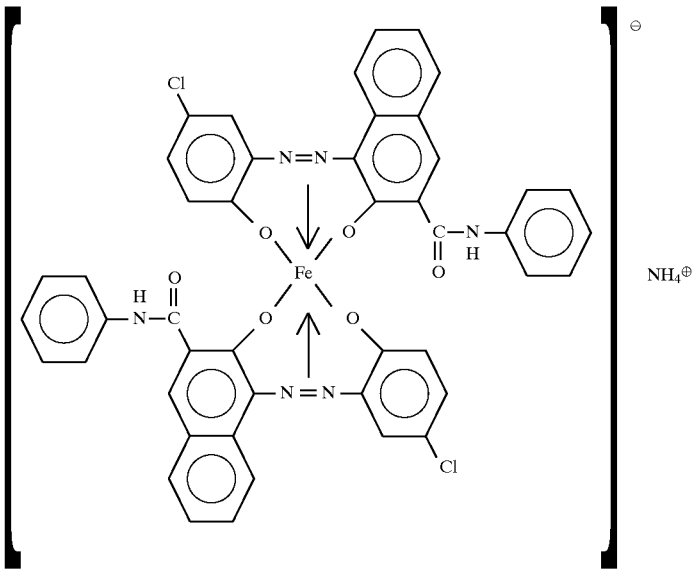

-continued
Azo iron compound (2):
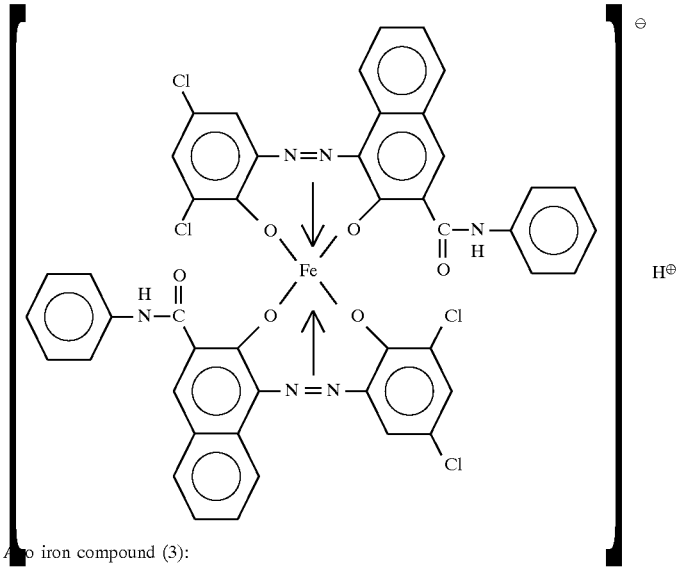
Azo iron compound (3):
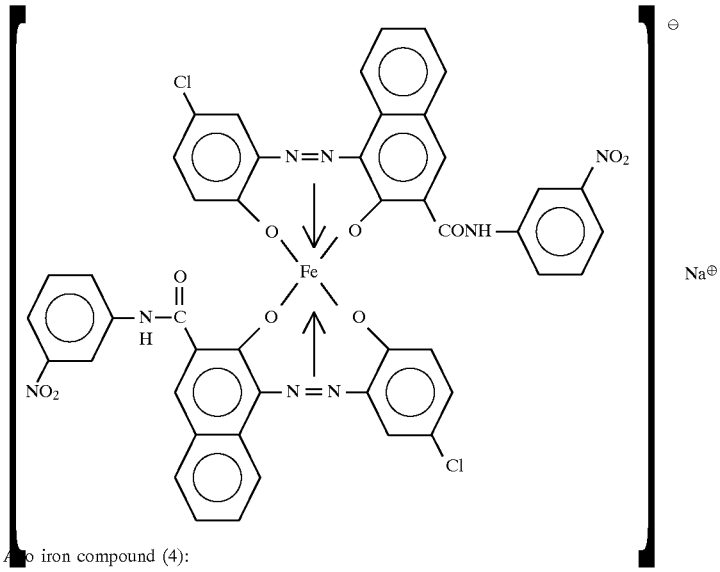
Azo iron compound (4):
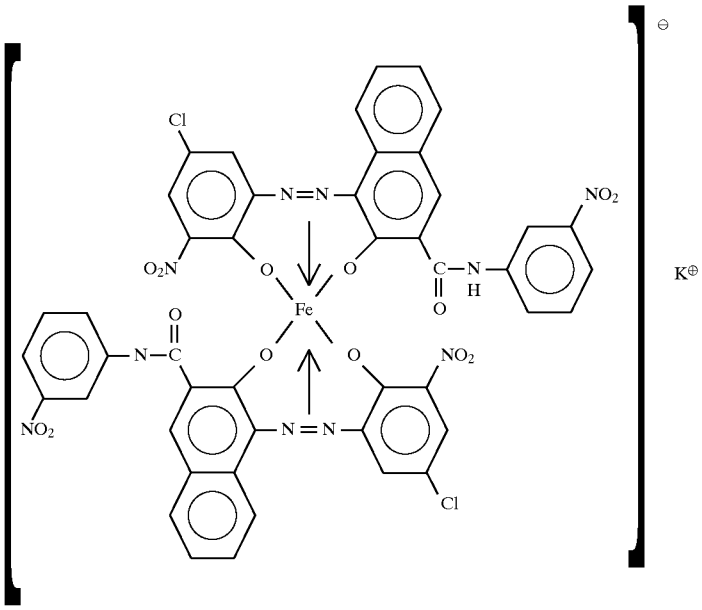

-continued

Azo iron compound (5):

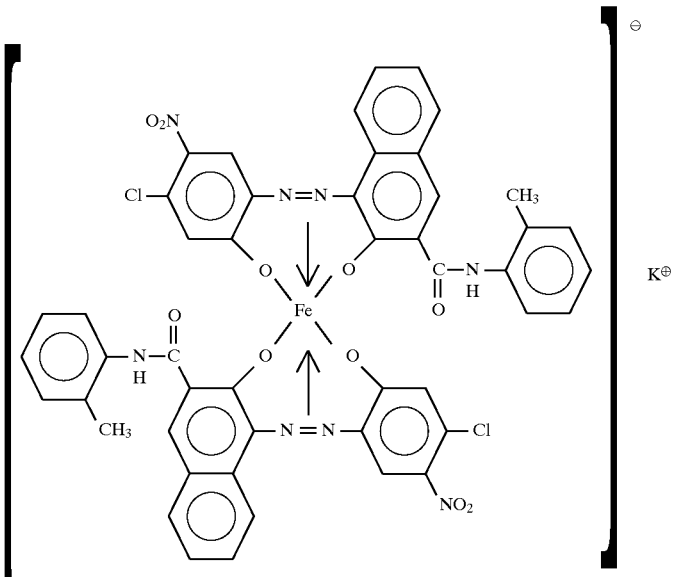

Azo iron compound (6):

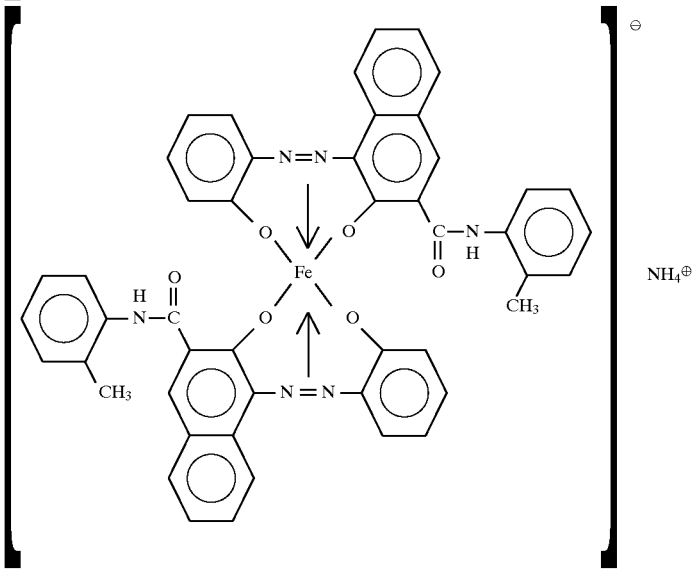

The azo iron compound used in the present invention may generally be formed by subjecting a diazo substituted aminophenol and a substituted naphthol to a coupling reaction and reacting the coupling product with an iron salt, such as iron sulfide.

The azo iron compound may be contained in 0.1 –8 wt. parts, preferably 0.1–6 wt. parts per 100 wt. parts of the binder resin. Below 0.1 wt. part, the above-mentioned effect is scarce and, in excess of 8 wt. parts, the soiling of charging member, etc., is liable to occur.

Examples of oxycarboxylic acid constituting the oxycarboxylic acid metal compound used in the present invention may include: malic acid, dimethylolbutanoic acid, tartaric acid, citric acid, salicylic acids, and naphthoic acid. Among these, alkylsalicylic acids and dialkylsalicylic acids including an alkyl group having at most 5 carbon atoms are preferred, and 3,5-dialkylsalicylic acids are especially preferred. As the alkyl group, t-butyl group is most preferred.

Other specific examples of the oxycarboxylic acid may include: 2-hydroxy-3-naphthoic acid, alkyl-2-hydroxy-3-naphthoic acids having an alkyl group of at most 5 carbon atoms, 5,6,7,8-tetrahalo-2-hydroxy-3-naphthoic acid.

On the other hand, examples of the metal species constituting the oxycarboxylic acid metal compound may include: aluminum, zinc, chromium, cobalt, nickel, copper, iron and zircon. Among these, aluminum and zinc compounds are particularly preferred when used in combination with the azo iron compound.

Preferred examples of the oxycarboxylic acid metal compound may include those represented by the following structural formulae (wherein $A^{\oplus}$ denotes an ion of hydrogen, an alkali metal or an alkaline earth metal):

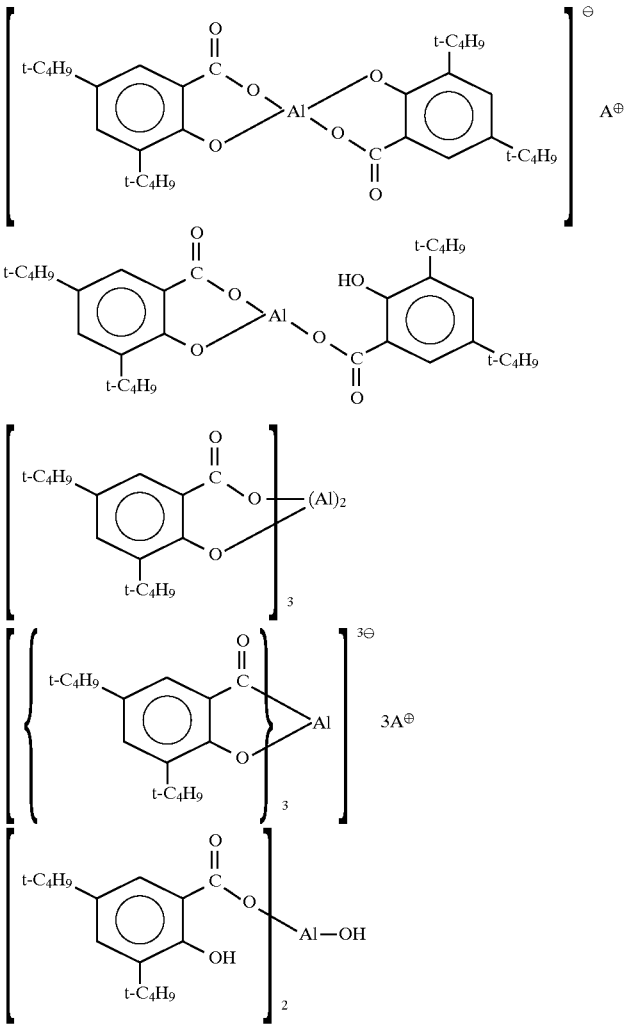

The oxycarboxylic acid metal compound may be used in 0.1–10 wt. parts, preferably 1–6 wt. parts, per 100 wt. parts of the binder resin. Below 0.1 wt. part, the above-mentioned effect is scarce and, above 10 wt. parts, the soiling of charging member, etc., is liable to occur similarly as the azo iron compound.

The toner particles of the present invention may preferably have shape factors SF-1 of 100–140 and SF-2 of 100–120.

The shape factors SF-1 and SF-2 referred to herein are based on values measured in the following manner. Sample particles are observed through a field-emission scanning electron microscope ("FE-SEM S-800", available from Hitachi Seisakusho K. K.) at a magnification of 1000, and 100 images of toner particles having a particle size (diameter) of at least 2 $\mu$m are sampled at random. The image data are inputted into an image analyzer ("Luzex 3", available from Nireco K. K.) to obtain averages of shape factors SF-1 and SF-2 based on the following equations:

$$\text{SF-1}=[(\text{MXLNG})^2/\text{AREA}]\times(\pi/4)\times 100,$$

$$\text{SF-2}=[(\text{PERI})^2/\text{AREA}]\times(1/4\pi)\ 100,]$$

wherein MXLNG denotes the maximum length of a sample particle, PERI denotes the perimeter of a sample particle, and AREA denotes the projection area of the sample particle.

The shape factor SF-1 represents the roundness of toner particles, and a shape factor SF-1 larger than 140 means that the shape of toner particles deviates from a sphere and approaches to an indefinite shape. The shape factor SF-2 represents the roughness of toner particles, and a shape factor SF-2 larger than 120 means a noticeable surface roughness of the toner particles.

The control of the shape factors of the toner at small values as described above are advantageous in the following respects. Firstly, as the toner is caused to have a smaller contact area with the photosensitive member to show a lower attachment force, the toner can be transferred at a high efficiency.

Figure 2:
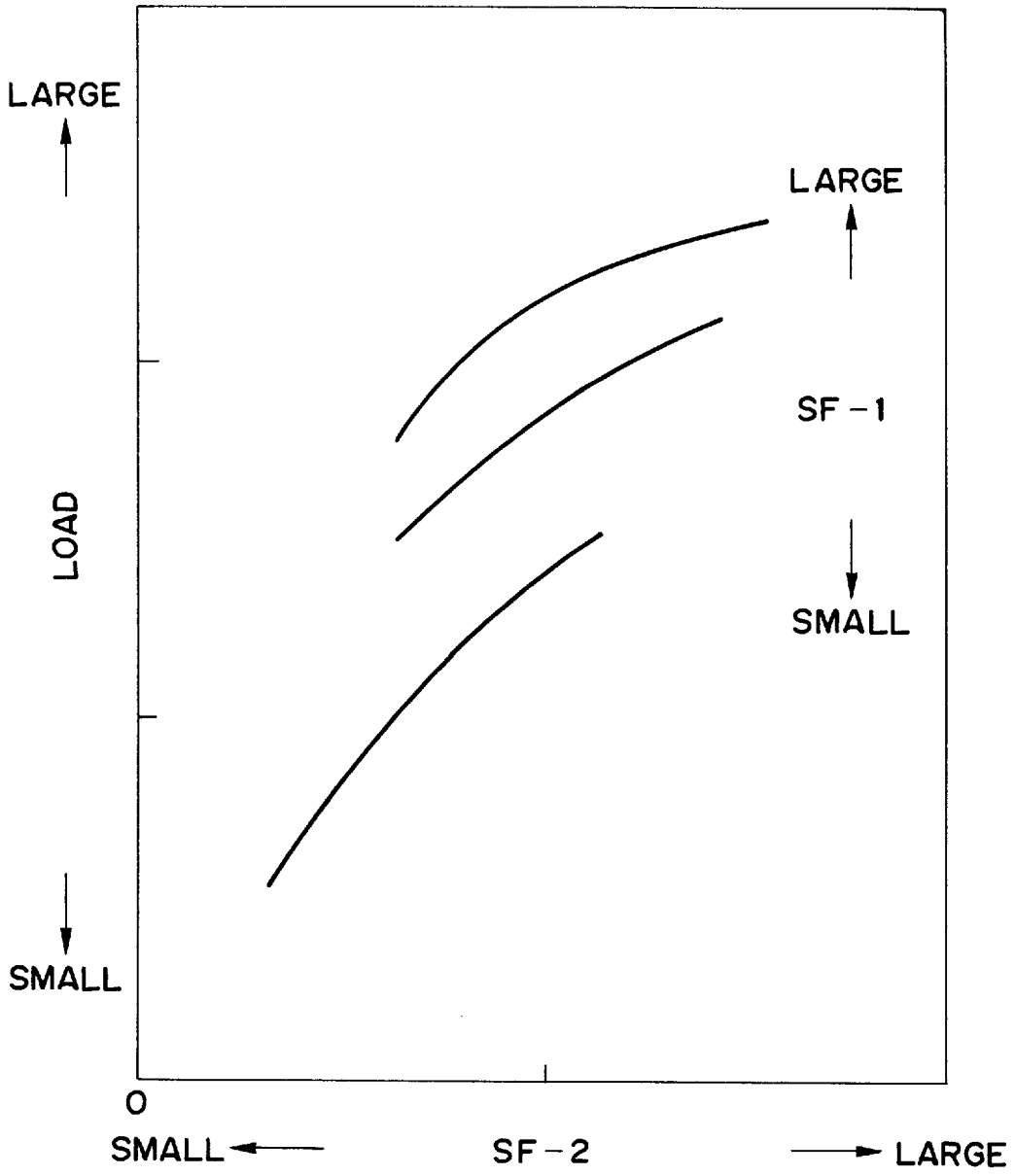
FIG. 2 is a graphic illustration of a relationship between a frictional load (a reciprocal of lubricity exerted by a toner) applied to a photosensitive drum and shape factors of a toner.

FIG. 2 graphically illustrates a relationship between the transfer efficiency and the shape factors. As shown in the figure, smaller shape factors provide a higher transfer efficiency. As a result, the amount of transfer residual toner recovered within the cleaning device is reduced to allow a reduction in Size of the cleaning device.

As a second advantage, if spherical toner particles having smooth and uniform surfaces are used, the charge of the toner after being transferred onto a transfer material becomes uniform, whereby it becomes possible to prevent a re-transfer phenomenon that the once-transferred toner image is peeled off to be taken up by the photosensitive drum when the transferred toner image reaches an additional image forming step as in the case of a multi-color image formation. As a result, the toner image on the transfer material is not disordered but results in a high-quality image.

Thirdly, the use of a smaller-diameter photosensitive drum is allowed. More specifically, by using spherical and smooth-surfaced toner particles as represented by small shape factors, it becomes possible to reduce the frictional force acting between the photosensitive drum and the cleaner member, thereby preventing the wearing of the photosensitive drum.

Figure 3:
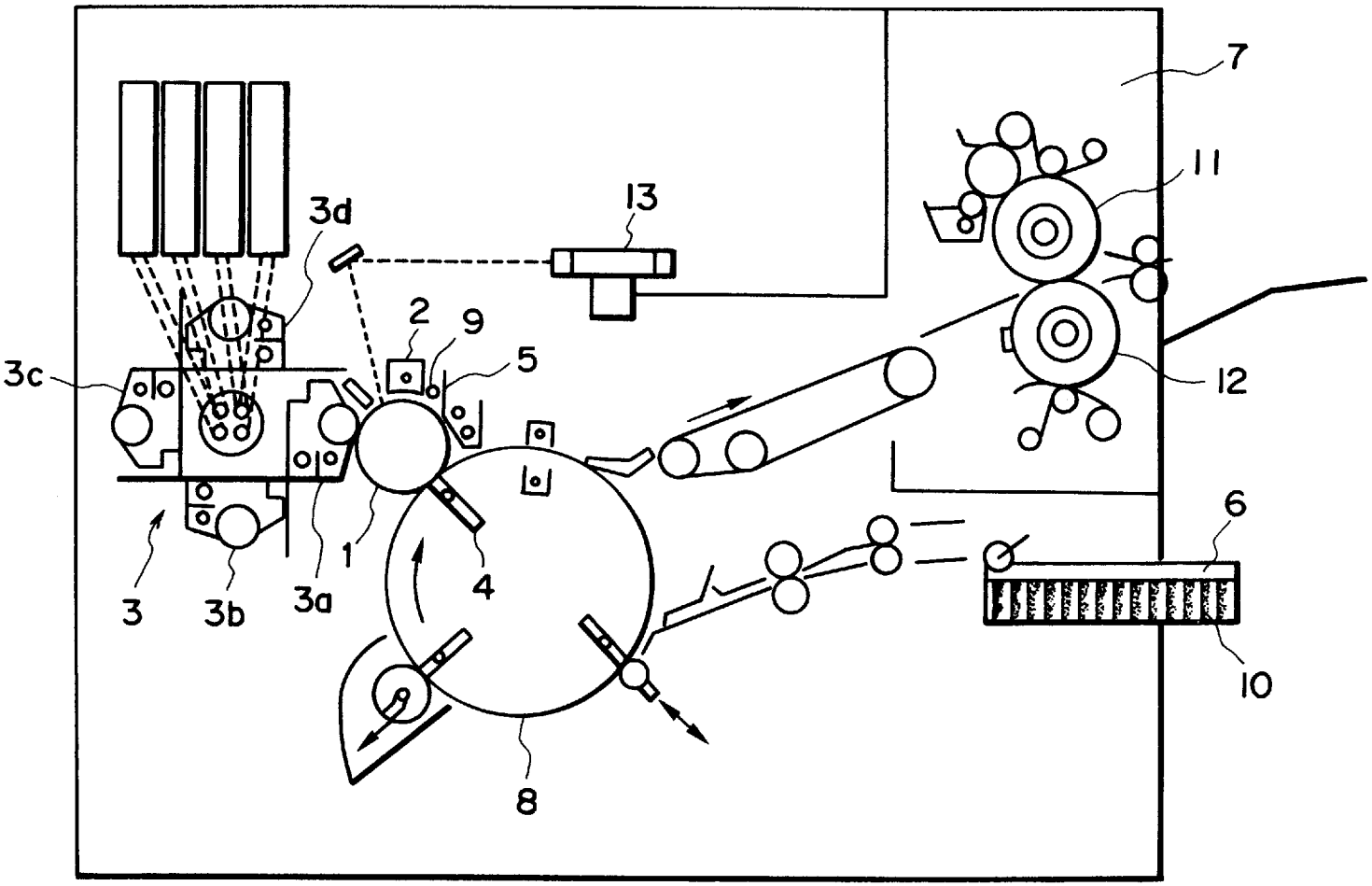
FIG. 3 is a schematic illustration of an example of image forming apparatus to which the toner of the invention is suitably applicable.

FIG. 3 graphically illustrates a relationship between a load (as exerted by a cleaning member as a reciprocal of lubricity of the toner particles) and shape factors of the toner particles. FIG. 3 is based on the measurement of a frictional load (minimum pulling force) for movement when toner particles are applied on a glass sheet and a urethane rubber sheet carrying a load of 300 g is placed and pulled in a horizontal direction parallel to the glass sheet. As shown in FIG. 3, toner particles having smaller shape factors exhibit a higher lubricity (a smaller load). This has been confirmed by a remarkably reduced wearing and an increased life of the photosensitive drum.

However, the use of such a spherical and smooth-surfaced toner as represented by small shape factors is disadvantageous in chargeability because of reduced contact points between the toner surface and the charging member compared with an indefinite-shaped toner as mentioned above, and is liable result in problematic phenomenon of toner scattering and fog, e.g., in a high humidity environment.

In the present invention, however, by incorporating a specific azo iron compound and an oxycarboxylic acid metal compound as described above, the toner particles are allowed to have small shape factors while ensuring a good chargeability level, thereby allowing a high transfer efficiency, prevention of the re-transfer and use of a small-diameter drum.

The toner particles according to the present invention having such low shape factors may be produced through polymerization processes, inclusive of suspension polymerization processes for direct toner production as described in JP-B 36-10231, JP-A 59-53856 and JP-A 53-61842; a dispersion polymerization process for direct toner production using an aqueous organic solvent in which a monomer is soluble but the resultant polymer is insoluble, and emulsion polymerization processes as represented by a soap-free polymerization process wherein a toner is directly produced by polymerization in the presence of a water-soluble polar polymerization initiator.

In the present invention, it is particularly preferred to adopt a suspension polymerization process under a normal pressure or an elevated pressure capable of relatively easily providing fine toner particles of 3–10 $\mu$m in diameter at a sharp particle size distribution while easily controlling the shape factors SF-i at 100–140 and SF-2 at 100–120. The control of average particle size and particle size distribution may be achieved by changing the species and amount of a hardly water-soluble inorganic salt or a dispersant functioning as a protective colloid, and mechanical apparatus conditions including stirring conditions, such as a rotor peripheral speed, a number of passes and a stirring blade shape, or a vessel shape, and a solid matter concentration in the aqueous medium.

The toner according to the present invention may comprise an ordinary toner-constituting resin, inclusive of styrene polymers, styrene-acrylic copolymers and styrene-methacrylic copolymers.

In the direct production of toner particles through the polymerization process, the corresponding monomers may be used. Specific examples thereof may include: styrene monomers, such as styrene, o-(m-, p-)methylstyrene, and m-(p-)ethylstyrene; acrylate monomers, such as methyl (meth)acrylate, ethyl (meth)acrylate, propyl (meth)acrylate, butyl (meth)acrylate, octyl (meth)acrylate, dodecyl (meth) acrylate, stearyl (meth)acrylate, behenyl (meth)acrylate, 2-ethylhexyl (meth)acrylate, dimethylaminoethyl (meth) acrylate, and diethylaminoethyl (meth)acrylate; butadiene, isoprene, cyclohexane, (meth)acrylonitrile, and acrylamide. These monomers may be used singly or in mixture so as to provide a theoretical glass transition temperature (Tg) of 40°–75° C. as obtained in a manner described in Polymer Handbook 2nd Ed. III, pp. 139–192 (John Wiley & Son). In case of a theoretical glass transition temperature of below 40° C., the resultant toner or developer is liable to have inferior storage stability or continuous image forming performances. On the other hand, in excess of 75° C., the resultant toner is caused to have an elevated fixable temperature and particularly an insufficient color mixability to result in poor color reproducibility in the case of a toner for full color image formation. Further, the transparency of an OHP image can be remarkably lowered, and high image quality may not be expected.

The molecular weight and its distribution of a binder resin may be determined through GPC (gel permeation chromatography) measurement. As a specific GPC measurement method, a toner sample may be subjected to 20 hours of extraction with toluene solvent by means of a Soxhlet extract, and then toluene is distilled off from the extract by a rotary evaporator. The residual extract is then sufficiently washed by adding an organic solvent, such as chloroform, capable of dissolving an ester wax but not dissolving a binder resin, and then dissolved in THF (tetrahydrofuran). The resultant THF solution is filtrated through a solvent-resistant membrane filter having a pore diameter of 0.3 $\mu$m. Then, the filtrate sample may be subjected to measurement by using a GPC apparatus ("GPC-150C", available from Waters Co.) together with a combination of columns A-801, 802, 803, 804, 805, 806 and 807 available from Showa Denko K. K. to obtain a molecular weight distribution with reference to a calibration curve which has been obtained by using standard polystyrene resin samples. As a result of such a GPC measurement, the binder resin constituting the toner according to the present invention may preferably have a number-average molecular weight (Mn) of 5,000—$10^5$, and a ratio (Mw/Mn) between a weight-average molecular weight (Mw) and the number-average molecular weight (Mn) of 2–100.

The toner particles can contain a polar polymer or copolymer as a result of addition of such a polar polymer or copolymer into the polymerizable monomer composition.

Examples of such a polar polymer or a polar copolymer may include: polymers of nitrogen-containing monomers, such as dimethylaminoethyl methacrylate, and diethylaminoethyl methacrylate, and copolymers of such nitrogen-containing monomers and styrene monomers; styrene-unsaturated carboxylic acid ester copolymers; polymers and copolymers with a styrene monomer of monomers including nitrile monomers such as acrylonitrile, halogen-containing monomers such as vinyl chloride, unsaturated carboxylic acids such as acrylic acid and methacrylic acid, unsaturated dibasic acids, unsaturated dibasic acid anhydrides and nitro group-containing monomers; polyester resins, polycarbonate resins, and epoxy resins.

In the toner according to the present invention, carbon black is used as a colorant. It is particularly preferred to use carbon black having an average primary particle size of 1–70 nm, a BET specific surface area according to nitrogen adsorption (SBET) of at most 100 $m^2/g$, a pH of at least 2.0, a volatile matter content of at most 2 wt. %, and a DBP (dibutyl phthalate) absorptivity of 50–200 ml/g.

The carbon black may have an average primary article size of 10–70 nm, more preferably 20–60 nm, further preferably 25–45 nm. If the carbon black has an average primary particle size of below 10 nm, the polymerizable monomer composition containing the carbon black as well as the specific azo iron compound is liable to have an excessively large viscosity, and the fine particle formation thereof without agglomeration becomes difficult. Further, because of too small a primary particle size, it becomes difficult to disperse the carbon black in the polymerizable monomer composition. On the other hand, if the carbon black has an average primary particle size in excess of 70 nm, only a low coloring power can be attained even if it is well dispersed and, when used in a large amount in order to increase the coloring power, the resultant toner is caused to have a lower chargeability.

It is preferred that the carbon black has a pH of at least 2.0, more preferably at least 4.0. If the carbon black has a pH below 2.0, the carbon black is caused to have many functional groups, which are liable to inhibit the polymerization.

It is preferred that the carbon black has a specific surface area ($S_{BET}$) of at most 100 $m^2/g$, more preferably 30–90 $m^2/g$, further preferably 40–90 $m^2/g$. The volatile matter content of the carbon black may preferably be at most 2 wt. %, more preferably 0.1–1.8 wt. %, further preferably 0.1–1.7 wt. %. If the specific surface area exceeds 100 $m^2/g$, the polymerization is liable to be inhibited. A volatile matter content in excess of 2 wt. % means the presence of much polymerization inhibiting groups, thus being not suitable for providing the polymerization toner according to the present invention.

The DBP absorptivity of the carbon black is preferably 50–200 ml/100 g, more preferably 110–200 $m^2$ /g, further preferably 120–160 ml/100 g. If the DBP absorptivity is below 50 ml/100 g, the carbon black cannot be sufficiently dispersed in the toner particles, thus being liable to exhibit a lower coloring power. In excess of 200 ml/g, the resultant toner particles are caused to have an excessively high conductivity, thus resulting in a lower chargeability particularly in a high humidity environment.

The carbon black may be added in 1–20 wt. parts per 100 wt. parts of the binder resin and, in order to exhibit a good dispersibility, more preferably be added in C wt. parts relative to A wt. parts of the azo iron compound, satisfying $3 \leqq C/A \leqq 50$, further preferably $3 \leqq C/A \leqq 38$.

If the amount of the azo iron compound is low relative to the carbon black ($C/A>50$), the viscosity of the polymerizable monomer composition is not sufficiently raised, so that it is difficult to stably disperse the carbon black. In this case, the carbon black is gradually precipitated with lapse of time, the resultant toner is liable to fail in exhibiting a sufficient coloring power.

If the azo iron compound is excessively large in amount relative to the carbon black ($C/A<3$), the azo iron compound is liable to cause secondary agglomeration, thus exhibiting a lower dispersibility in the polymerizable monomer, and the secondary agglomerate is liable to inhibit the polymerization, thus making it difficult to recover the polymerizate as toner particles.

The effect of the azo iron compound addition for improving the dispersibility of carbon black has been confirmed, e.g., through a following test. A polymerizable mixture comprising 60 wt. parts of styrene, 1 wt. part of an azo iron compound and 10 wt. parts of carbon black was stirred by means of a stirrer at 200 rpm for 180 min. On the other hand, another polymerizable mixture was prepared similarly except for omitting the addition of the azo iron compound. The two mixtures were tested by standing for evaluation of dispersion stability. As a result, the mixture containing no azo iron compound caused precipitation after 3 days, whereas the mixture containing the azo iron compound was free from precipitation even after 30 days of standing.

The above-mentioned values for the respective properties of carbon black are based on values measured according to the follow ing methods:

(1) DBP absorptivity

Measured by dripping DBP (dibutyl phthalate) onto a dry sample of carbon black (according to JIS K6221, A-method).

(2) Specific surface area ($S_{BET}$) according to nitrogen adsorption

Measured according to ASTM D3037.

(3) Volatile matter content

Determined by measuring the weights before and after heating of a carbon black sample (according to JIS K6221).

(4) Average primary particle size

A number-average primary particle size is determined by using a transmission electron microscope at a magnification of 30,000 for 100 particles selected at random (according to ASTM D3849-89).

(5) pH

A carbon black sample is mixed with water in an amount of 10 ml for 1 g-carbon black and boiled together, followed by cooling and removal of a supernatant liquid to leave a muddy sample, of which a pH value is measured (according to JIS K6221).

The toner according to the present invention is constituted as a black toner containing carbon black but, in addition to monochromatic use, can also be used to form full color images by using it in combination with a yellow toner, a magenta toner and a cyan toner provided separately.

Further, the toner according to the present invention may be constituted as either a non-magnetic toner or a magnetic toner. In the magnetic toner, a powdery magnetic material may be added in 40–150 wt. parts per 100 wt. parts of the binder resin.

The toner particles used in the present invention may be directly formed by polymerization of a polymerizable monomer composition containing or in the presence of a polymerization initiator, examples of which may include: azo-type or diazo-type polymerization initiators, such as 2,2'-azobis(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile; and peroxide-type polymerization initiators, such as benzoyl peroxide, methyl ethyl ketone peroxide, diisopropyl peroxycarbonate, cumene hydroperoxide, 2,4-dichlorobenzoyl peroxide, and lauroyl peroxide.

The addition amount of the polymerization initiator may depend on the objective polymerization degree of the binder resin but may generally be in a proportion of 0.5–20 wt. % of the polymerizable monomer. The particular polymerization initiator to be used may somewhat vary depending on the polymerization method but one or more of polymerization initiators as mentioned above may be selected with reference to their 10 hour-half life temperature.

It is also possible to further add a crosslinking agent, a chain transfer agent, a polymerization inhibitor, etc., known in the art, in order to control the polymerization degree.

During the suspension polymerization for producing the toner according to the present invention, an inorganic or/and an organic dispersion stabilizer may be used in an aqueous dispersion medium. Examples of the inorganic dispersion stabilizer may include: tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, and alumina. Examples of the organic dispersion stabilizer may include: polyvinyl alcohol, gelatin, methyl cellulose, methyl hydroxypropyl cellulose, ethyl cellulose, carboxymethyl cellulose sodium salt, and starch. These dispersion stabilizers may preferably be used in the aqueous dispersion medium in an amount of 0.2–10 wt. parts per 100 wt. parts of the polymerizable monomer.

In the case of using an inorganic dispersion stabilizer, a commercially available product can be used as it is, but it is also possible to form the stabilizer in situ in the dispersion medium so as to obtain fine particles thereof. In the case of tricalcium phosphate, for example, it is adequate to blend an aqueous sodium phosphate solution and an aqueous calcium chloride solution under an intensive stirring to produce tricalcium phosphate particles in the aqueous medium, suitable for suspension polymerization. In order to effect fine dispersion of the dispersion stabilizer, it is also effective to use 0.001–0.1 wt. % of a surfactant in combination, thereby promoting the prescribed function of the stabilizer. Examples of the surfactant may include: sodium dodecylbenzenesulfonate, sodium tetradecyl sulfate, sodium pentadecyl sulfate, sodium octyl sulfate, sodium oleate, sodium laurate, potassium stearate, and calcium oleate.

In case where the toner according to the present invention is produced through the direct polymerization, toner particles may be produced directly in the following manner. Into a polymerizable monomer, carbon black, the charge control agent, a polymerization initiator, and other additives are added and uniformly dissolved or dispersed by a homogenizer or an ultrasonic dispersing device, to form a polymerizable monomer composition, which is then dispersed and formed into particles in a dispersion medium containing a dispersion stabilizer by means of an ordinary stirrer, a homomixer or a homogenizer preferably under such a condition that droplets of the polymerizable monomer composition can have a desired particle size of the resultant toner particles by controlling stirring speed and/or stirring time. Thereafter, the stirring may be continued in such a degree as to retain the particles of the polymerizable monomer composition thus formed and prevent the sedimentation of the particles. The polymerization may be performed at a temperature of at least 40° C., generally 50°–90° C. The temperature can be raised at a later stage of the polymerization. It is also possible to subject a part of the aqueous system to distillation in a latter stage of or after the polymerization in order to remove the yet-unpolymerized part of the polymerizable monomer and a by-product which can cause an odor in the toner fixation step. After the reaction, the produced color toner particles are washed, filtered out, and dried. In the suspension polymerization, it is generally preferred to use 300–3000 wt. parts of water as the dispersion medium per 100 wt. parts of the monomer composition.

As a preferred method of effecting a more uniform dispersion of carbon black, it is possible to adopt a master batch preparation step. Thus, before adding the carbon black, the charge control agents, the polymerization initiator and other additives to the polymerizable monomer, only the carbon black and the azo iron compound are added to and mixed with portion of the polymerizable monomer. As a result, the carbon black is blended and dispersed at a higher concentration in the dispersion liquid, so that a high shearing force can be applied to the carbon black, thereby improving the dispersibility of the carbon black in combination with the dispersion improving effect given by the addition of the azo iron compound.

The toner according to the present invention may preferably have a weight-average particle size ($D_4$) of 3.0–10.0 $\mu$m, preferably 3.0–8.0 $\mu$m.

In case where the toner has a weight-average particle size of 10.0 $\mu$l or below, a good highlight reproducibility can be attained and, if it is 3.0 $\mu$m or above, a charge-up phenomenon or image density lowering particularly in a low humidity environment is less liable to occur.

The particle size distribution of a toner may be measured by using a Coulter counter Model TA-II or Coulter Multisizer (respectively available from Coulter Electronics Inc.).

In the measurement, a 1%-NaCl aqueous solution may be prepared by using a reagent-grade sodium chloride as an electrolytic solution. It is also possible to use ISOTON R-II (available from Coulter Scientific Japan K. K.). Into 100 to 150 ml of the electrolytic solution, 0.1 to 5 ml of a surfactant, preferably an alkylbenzenesulfonic acid salt, is added as a dispersant, and 2 to 20 mg of a sample is added thereto. The resultant dispersion of the sample in the electrolytic liquid is subjected to a dispersion treatment for about 1–3 minutes by means of an ultrasonic disperser, and then subjected to measurement of particle size distribution in the range of at least 2 $\mu$m by using the above-mentioned apparatus with a 100 $\mu$m-aperture to obtain a volume-basis distribution and a number-basis distribution. The weight-average particle size ($D_4$) and the number-average particle size ($D_1$) may be obtained from the volume-basis distribution and the number-basis distribution, respectively by using a central value as a representative value for each channel.

The toner according to the present invention can constitute either a mono-component type developer or a two-component type developer. In the case of providing a two-component type developer for the magnetic brush development method, the toner may be blended with a carrier, which may comprise powder of ferrite, magnetite or iron optionally coated with an acrylic resin, a silicone resin, a fluorine-containing resin, etc. The toner according to the present invention may also constitute a mono-component type developer in the form of either a magnetic toner or a non-magnetic toner.

FIG. 3 illustrates an example of image forming apparatus to which the toner of the present invention formulated into a two-component type developer is suitably applicable.

Referring to FIG. 3, the apparatus includes an image forming section provided with one photosensitive drum (image-bearing member) 1, around which a drum charger 2, an exposure lamp 9 and a polygonal mirror 13 for image light scanning are disposed. Laser light issued from a light source (not shown) is scanned by rotation of the polygonal mirror 13, deflected by a reflection mirror and condensed by an f-θ lens to form scanning laser light condensed and scanning along a generatrix on the rotating photosensitive drum 2, thereby forming an electrostatic latent image corresponding to given image signals.

Then, the latent image on the photosensitive drum 1 is developed with a developer in a developing device 3*a* (or 3*b*–3*d*) in a developing unit 3 to form a visible image (toner image) on the photosensitive drum 1. Further, a recording material 6 as a transfer(-receiving) material stored in a cassette 10 is electrostatically carried by a transfer material-carrying member 8 rotated in synchronism with the photosensitive drum 1 and conveyed to a transfer position, where the toner image on the photosensitive drum 1 is transferred onto the recording material 6 by the action of a transfer charger 4.

The above operations may be repeated sequentially in several cycles to form superposed toner layers in registration with each other on a single recording material 6. After completing the cycles, the recording material 6 is separated from the recording material-carrying member 8 by the action of a separation claw, etc., and conveyed by a conveyer belt to a fixing device 7, wherein the recording material 6 carrying the superposed toner images is passed under application of heat and pressure between a fixing roller 11 and a pressure roller 12 to provide a toner image fixed on-to the recording material by a single fixing operation. The residual toner particles remaining on the photosensitive drum 1 without being transferred onto the recording material are removed from the photosensitive drum 1 by a cleaning device 5.

Hereinbelow, the present invention will be described more specifically based on Examples and Comparative Examples, wherein "part(s)" used in describing a formulation is "part(s) by weight" unless otherwise noted specifically.

(Production Example 1 for Aluminum Compound)

0.2 mol of di-tert-butylsalicylic acid added to 1 liter of a 0.25 mol/l-NaOH aqueous solution and dissolved therein under heating. The solution was added to 1 liter of 0.05 mol/l-$Al_2(SO_4)_3$ aqueous solution under heating and stirring, and the product was recovered by filtration under a neutral to weakly alkaline condition. The recovered product was washed with water until the washing liquid became neutral, followed by drying to recover objective di-tert-butylsalicylic acid aluminum compound.

Further, as a result of analyzing an FE (field desorption) mass spectrum of the product, the product principally comprised a compound of the oxycarboxylic acid and aluminum bonded in a ratio of 3:2 by mol.

(Production Example 2 for Aluminum Compound)

2-Hydroxynaphthalene-3-carboxylic acid aluminum compound was produced at a purity of almost 100% through a similar synthesis process as in Production Example 1 except for using 2-hydroxynaphthalene-3-carboxylic acid in place of di-tert-butylsalicylic acid.

(Production Example 3 for Zinc Compound)

Di-tert-butylsalicylic acid zinc compound was prepared through a similar synthesis process as in Production Example 1 except for using $ZnSO_4$ aqueous solution instead of the $Al_2(SO_4)$ aqueous solution.

[Production Example A for Polymerization Toner]

450 wt. parts of 0.1M-$Na_3PO_4$ was charged into 710 wt. parts of de-ionized water, and the mixture was heated to 60° C. and stirred at 12000 rpm by a TK-homomixer (available from Tokushu Kika Kogyo K. K.), followed by addition of 68 wt. parts of 1.0M-$CaCl_2$ aqueous solution, to obtain an aqueous medium containing $Ca_3(PO_4)_2$.

| | |
|---|---|
| Styrene | 80 part(s) |
| n-Butyl acrylate | 20 parts(s) |
| Carbon black | 10 parts(s) |
| ($D_1$ (primary) = 40 nm, $S_{BET}$ = 50 $m^2/g$, pH = 7.0, DBP absorptivity = 137 ml/100 g) | |
| Di-tert-butylsalicylic acid Al compound | 1 parts(s) |
| Azo iron compound (1) | 1 parts(s) |
| Saturated polyester resin ($P_{MW}$ (peak molecular weight = 7600; A.V. (acid value) = 8 mg KOH/g) | 5 parts(s) |
| Ester wax ($T_{m.p.}$ = 75° C.) | 15 parts(s) |

The above ingredients were heated to 60° C. and subjected to stirring at 12000 rpm by a TK-homomixer (available from Tokushu Kika Kogyo K. K.) for uniform dissolution and dispersion, and 5 parts of 2,2'-azobis(2,4-dimethylvaleronitrile) was dissolved therein to form a polymerizable monomer composition.

Separately, an identical polymerizable monomer composition except for omitting the polymerization initiator was prepared and subjected to standing for evaluation of dispersion stability, whereby no precipitation was observed even after 30 days of standing.

The polymerizable monomer composition was charged into the above-prepared aqueous medium and stirred at 10000 rpm by a TK-homomixer for 10 min. at 60° C. in an $N_2$ atmosphere to form particles of the polymerizable monomer composition. Then, the system was stirred by means of a paddle stirring blade and heated to 80° C. for 10 hour of reaction. After the polymerization reaction, the residual monomer was distilled off under a reduced pressure and, after cooling, hydrochoric acid was added to the system to dissolve the calcium phosphate. Then, the polymerizate particles were filtered out, washed with water and dried to obtain polymerizate Toner particles A having a weight-average particle size of ca. 7.5 $\mu$m and a sharp particle size distribution. The properties of Toner particles A are shown in Tables 3 and 4 together with those of toner particles prepared in other Production Examples described hereinbelow.

98.5 wt. parts of Toner particles A prepared above were blended with 1.5 parts of hydrophobic silica having a BET specific surface area (SBET) of 200 $m^2/g$ to obtain Toner A (polymerization toner), 5 parts of which was blended with 95 parts of an acrylic resin-coated magnetic ferrite carrier to obtain Developer A (two-component type developer).

As a result of the shape factor measurement, Toner A exhibited SF-1=111 and SF-2=109.

[Production Examples B–S for Polymerization Toners]

Toner particles B–S were prepared in similar manners as in Production Example A except for changing the species and amounts of the azo iron compounds and oxycarboxylic acid metal compounds as shown in Tables 1 and 2. Toner particles B–S were then formulated similarly as in Production Example A into Toners B–S by external addition of the hydrophobic silica and into Developers B–S by further blending with the acrylic resin-coated magnetic ferrite carrier.

Separately, in Production Example L for providing a polymerization Toner L containing no azo iron compound, an identical polymerizable monomer composition except for further omitting the polymerization initiator was prepared and subjected to standing for evaluation of dispersion stability, hereby the carbon black was precipitated in three days of standing.

| [Production Example T for polymerization toner] | |
|---|---|
| Styrene | 60 part(s) |
| Carbon black | 10 part(s) |
| Azo iron compound (1) | 1 part(s) |

The above ingredients were stirred for 3 hours for dispersion in an attritor ("Attritor 1S", available from Mitsui Kozan K. K.) to form a master batch dispersion liquid.

The above-prepared master batch

| | |
|---|---|
| dispersion liquid | 71 part(s) |
| Styrene | 20 part(s) |
| n-Butyl acrylate | 20 part(s) |
| Di-tert-butylsalicylic acid Al compound | 1 part(s) |
| Saturated polyester resin | 5 part(s) |
| Ester wax | 15 part(s) |

The above ingredients were heated to 60° C. and subjected to stirring at 12000 rpm by a TK-homomixer for uniform dissolution and dispersion, and then 5 parts of 2,2'-azobis(2,4-dimethylvaleronitrile) was dissolved therein to form a polymerizable monomer composition.

By using the polymerizable monomer composition otherwise in the same manner as in Production Example 1, Toner particles T were prepared. From Toner particles T, Toner T and Developer T (two-component type) were prepared similarly as in Production Example A.

Examples 1–17 and Comparative Examples 1–3

Each of the above-prepared Toners A–S (Developers A–S) were subjected to a black color-mode image formation test by using a commercially available color copying machine ("CLC-500", available from Canon K. K.) having an organization as illustrated in FIG. 3 after remodeling so as to provide variable developing contrasts for the black color-mode image formation test.

Each toner was evaluated in environments of normal temperature/low humidity (N.T./L.H.=23° C./5%RH), normal temperature/normal humidity (N.T./N.H.=23° C./65%RH) and/or high temperature/high humidity (H.T./H.H.=30° C./80%RH, under developing contrasts of 400 volts for N.T./L.H., 320 volts for N.T./N.H. and 250 volts for H.T./H.H. with respect to transfer efficiency, start-up chargeability, charging stability, toner scattering, fog, and image density, according to the following methods and evaluation standards.

(1) Transfer Efficiency

In the environment of N.T./N.H., a solid black image is formed on the photosensitive drum and recovered by adhesion with a transparent adhesive type. The recovered toner image is subjected to measurement of an image density (D1) by a color reflection densitometer ("X-RITE-404A", manufactured by X-Rite Co.). Then, a solid black image is again formed on the photosensitive drum and transferred onto a recording material, and the solid black image on the recording material is recovered by adhesion with an identical transparent adhesive tape. The image density (D2) of the recovered image is measured, and a transfer efficiency is determined from the measured image densities (D1 and D2) according to the following formula $$\text{Transfer efficiency}(\%)=(D2/D1)\times 100.$$

(2) Start-up Chargeability

Each toner is subjected to a continuous copying test on 1000 sheets after 3 min. of blank rotation in the N.T./L.H. environment, and the charge at the initial stage ($TC_0$) of the image formation and the charge at the time on a 1000-th sheet ($TC_{1000}$) are measured with respect to the developer on the developing sleeve in the developing device. The start-up chargeability is evaluated according to the following standard based on a charge difference rounded-off % values) determined according to the following formula:

$$\text{Charge difference}(\%)=|(TC_{1000}-TC_0)/TC_{1000}|\times 100$$

A: 0–10%

B: 11–20%

C: 21–30%

D: 31–40%

E: 41–50%

F: ≧51%

(3) Charging Stability

Each toner is subjected to a continuous copying test on 50,000 sheets in the H.T./H.H. environment, and the toner charges at the time on the 1000-th sheet and at the time on the 50,000-th sheet ($TC_{1000}$ and $TC_{50000}$) are measured with respect to the developers in the developing sleeve. The charging stability is evaluated according to the following standard based on a percentage charge difference (%)=$|(TC_{50,000}-TC_{1000})/TC_{50,000}|\times 100$).

A: 0–10%

B: 11–20%

C: 21–30%

D: 31–40%

E: 41–50 %

F: ≧51%

(4) Toner Scattering

Each toner is subjected to a continuous image formation on 50,000 sheets in the N.T./N.H. environment. Thereafter, the developing device is taken out of the image forming apparatus and set on a blank rotation device. An A4-size paper is placed immediately blow the developing sleeve of the developing device, and the sleeve is subjected to 10 min. of blank rotation, whereby the weight of toner having fallen onto the A4-size paper is measured. The toner scattering is evaluated based on the toner weight (rounded-off values) according to the following standard:

A: ≦3 mg

B: 4–6 mg

C: 7–9 mg

D: 10–12 mg

E: 13–15 mg

F: ≧16 mg (5) Fog

In the H.T./H.H. environment, an image is formed on a white paper, and the reflection density of a white background portion of the white paper after image formation is measured by a reflection densitometer ("TC6MC", available from Y. K. Tokyo Denshoku Gijutsu Center). The increase in measured image density compared with the reflection image density of a blank while paper before image formation is determined as a % increase value with respect to the image density of the white paper. Fog is evaluated based on the % increase value (rounded-off values) according to the following standard.

A: 0.≦5 %

B: 0.6–1.0%

C: 1.1–1.5%

D: 1.6–2.0%

E: 2.1–4.0%

F: ≧4.1%

(6) Image Density

A solid black image is formed at an initial stage and after a continuous image formation on 30,000 sheets, respectively, the image density of the respective solid black images are measured by a Macbeth densitometer.

The result of evaluation for the respective toner are inclusively shown in Table 5.

TABLE 1

| Toner particles | Polymerizable monomer composition* Carbon black (wt. parts) | Oxycarboxylic acid metal compound (wt. parts) | Azo iron compound (wt. parts) |
|---|---|---|---|
| A | 10 | 1.0 | 1.0 |
| B | 10 | 1.0 | 1.0 |
| C | 10 | 1.0 | 1.0 |
| D | 10 | 1.0 | 1.0 |
| E | 10 | 0.2 | 1.0 |
| F | 10 | 3.2 | 0.2 |
| G | 10 | 7.5 | 1.0 |
| H | 10 | 0.5 | 3.0 |
| I | 10 | 2.5 | 0.1 |
| J | 10 | 9.0 | 1.0 |
| K | 10 | 2.0 | 12 |
| L | 10 | 1.0 | 0 |
| M | 10 | 0 | 1.0 |
| N | 10 | 1.0 | 1.0 |
| O | 10 | 2.0 | 9.2 |
| P | 10 | 1.0 | 1.0 |
| Q | 10 | 5.0 | 3.0 |
| R | 10 | 3.0 | 5.0 |
| S | 10 | 1.0 | 1.0 |
| T | 10 | 1.0 | 1.0 |

*Each composition further contained 80 wt. parts of styrene (St); 20 wt. parts of n-butyl acrylate (n-BA), 5 wt. parts of saturated polyester and 15 wt. parts of ester wax.

TABLE 2

| Toner | Azo iron compound and Oxycarboxylic acid metal compound used for each toner: Azo iron compound Species | Amount A (wt. parts) | Oxycarboxylic acid metal compound Species* | Amount B (wt. %) | A/B |
|---|---|---|---|---|---|
| A | (1) | 1 | DTBSAl | 1 | 1 |
| B | (1) | 1 | 2HN3CAl | 1 | 1 |
| C | (2) | 1 | DTBSAl | 1 | 1 |
| D | (1) | 1 | DTBSZn | 1 | 1 |
| E | (1) | 0.2 | DTBSAl | 1 | 0.2 |
| F | (1) | 3.2 | DTBSAl | 0.2 | 16 |
| G | (1) | 7.5 | DTBSAl | 1 | 7.5 |
| H | (1) | 0.5 | 2HN3CAl | 3 | 0.17 |
| I | (2) | 2.5 | DTBSAl | 0.1 | 25 |
| J | (1) | 9 | DTBSZn | 1 | 9 |
| K | (1) | 2 | DTBSAl | 12 | 0.16 |
| L | (1) | 1 | — | — | — |
| M | — | — | DTBSAl | 1 | — |
| N | (1) | 1 | DTBSCo | 1 | 1 |
| O | (1) | 2 | DTBSAl | 9.2 | 0.22 |
| P | (7) | 1 | DTBSAl | 1 | 1 |
| Q | (1) | 5 | DTBSAl | 3 | 1.7 |
| R | (1) | 3 | DTBSAl | 5 | 0.6 |
| S | (1) | 1 | AcAcCo | 1 | 1 |
| T | (1) | 1 | DTBSAl | 1 | 1 |

*DTBSAl = di-tert-butylsalicylic acid aluminum compound
2HN3CAl = 2-hydrdxynaphthalene-3-carboxylic acid aluminum compound
DTBSZn = di-tert-butylsalicylic acid zinc compound
DTBSCo = di-tert-butylsalicylic acid cobalt compound
AcAcCo = acetylacetone cobalt compound

TABLE 3

| Toner particles | Toner particle composition (on analysis): St (wt. %) | n-Ba (wt. %) | Carbon black (wt. %) | Oxycarboxylic acid metal (wt. %) | Azo iron (wt. %) | Saturated polyester (wt. %) | Ester wax (wt. %) |
|---|---|---|---|---|---|---|---|
| A | 60.4 | 15.2 | 7.6 | 0.8 | 0.8 | 3.8 | 11.4 |
| B | 60.4 | 15.2 | 7.6 | 0.8 | 0.8 | 3.8 | 11.4 |
| C | 60.4 | 15.2 | 7.6 | 0.8 | 0.8 | 3.8 | 11.4 |
| D | 60.4 | 15.2 | 7.6 | 0.8 | 0.8 | 3.8 | 11.4 |
| E | 61.0 | 15.2 | 7.6 | 0.2 | 0.8 | 3.8 | 11.4 |
| F | 60.0 | 15.0 | 7.5 | 2.4 | 0.1 | 3.8 | 11.2 |
| G | 57.8 | 14.5 | 7.2 | 5.4 | 0.7 | 3.6 | 10.8 |
| H | 59.9 | 15.0 | 7.5 | 0.4 | 2.3 | 3.7 | 11.2 |
| I | 60.3 | 15.1 | 7.6 | 1.9 | 0.1 | 3.7 | 11.3 |
| J | 57.1 | 14.3 | 7.2 | 6.4 | 0.7 | 3.6 | 10.7 |
| K | 55.6 | 13.9 | 6.9 | 1.4 | 8.3 | 3.5 | 10.4 |
| L | 61.0 | 15.3 | 7.6 | 0.8 | 0 | 3.8 | 11.5 |
| M | 61.0 | 15.3 | 7.6 | 0 | 0.8 | 3.8 | 11.5 |
| N | 60.4 | 15.2 | 7.6 | 0.8 | 0.8 | 3.8 | 11.4 |
| O | 56.7 | 14.2 | 7.1 | 1.4 | 6.5 | 3.5 | 10.6 |
| P | 60.4 | 15.2 | 7.6 | 0.8 | 0.8 | 3.8 | 11.4 |
| Q | 58.0 | 14.5 | 7.2 | 3.6 | 2.2 | 3.6 | 10.9 |
| R | 58.0 | 14.5 | 7.2 | 2.2 | 3.6 | 3.6 | 10.9 |
| S | 60.4 | 15.2 | 7.6 | 0.8 | 0.8 | 3.8 | 11.4 |
| T | 60.4 | 15.2 | 7.6 | 0.8 | 0.8 | 3.8 | 11.4 |

TABLE 4

| Shape factors and size of toner particles | | | |
|---|---|---|---|
| Toner particle | SF-1 | SF-2 | Weight average particle size D4 ($\mu$m) |
| A | 110 | 109 | 6.5 |
| B | 111 | 110 | 6.6 |
| C | 110 | 110 | 6.4 |
| D | 112 | 111 | 6.6 |
| E | 112 | 111 | 6.6 |
| F | 110 | 113 | 6.9 |
| G | 111 | 113 | 6.8 |
| H | 115 | 114 | 6.8 |
| I | 112 | 110 | 6.6 |
| J | 115 | 116 | 6.9 |
| k | 112 | 113 | 7.0 |
| L | 109 | 109 | 6.6 |
| M | 114 | 113 | 6.9 |
| N | 112 | 110 | 6.6 |
| O | 112 | 114 | 7.0 |
| P | 114 | 113 | 6.6 |
| Q | 112 | 110 | 6.7 |
| R | 113 | 111 | 6.8 |
| S | 111 | 113 | 6.4 |
| T | 111 | 110 | 6.5 |

TABLE 5

| Toner evaluation results | | | | | | | | |
|---|---|---|---|---|---|---|---|---|
| | | | | H.T./H.H. | | | | |
| | | Transfer | Start-up | | | | Image density | |
| Ex. or Comp. Ex. | Toner | efficiency (%) | charge (N.T./L.H.) | Charge stability | Toner scatter | Fog | Initial | After 30000 sheets |
| Ex. | | | | | | | | |
| 1 | A | 98 | A | A | A | A | 1.50 | 1.48 |
| 2 | B | 97 | A | A | A | A | 1.49 | 1.47 |
| 3 | C | 98 | A | A | A | A | 1.51 | 1.49 |
| 4 | D | 98 | A | A | A | A | 1.50 | 1.48 |
| 5 | E | 98 | A | B | A | A | 1.49 | 1.46 |
| 6 | F | 97 | B | A | A | A | 1.50 | 1.48 |
| 7 | G | 98 | B | B | A | A | 1.50 | 1.47 |
| 8 | H | 98 | B | B | A | A | 1.51 | 1.48 |
| 9 | I | 97 | B | C | C | C | 1.49 | 1.44 |
| 10 | J | 96 | B | B | B | B | 1.49 | 1.46 |
| 11 | K | 98 | C | C | B | B | 1.49 | 1.44 |
| 12 | N | 97 | C | C | C | C | 1.49 | 1.44 |
| 13 | O | 97 | C | B | A | A | 1.50 | 1.47 |
| 14 | P | 96 | B | C | C | C | 1.51 | 1.46 |
| 15 | Q | 98 | A | A | A | A | 1.50 | 1.48 |
| 16 | R | 97 | A | A | A | A | 1.50 | 1.48 |
| 17 | T | 98 | A | A | A | A | 1.50 | 1.49 |
| Comp. Ex. | | | | | | | | |
| 1 | L | 97 | C | F | F | F | 1.49 | 1.39 |
| 2 | M | 97 | F | D | D | D | 1.48 | 1.41 |
| 3 | S | 96 | C | E | F | F | 1.49 | 1.41 |

What is claimed is:

1. A toner for developing electrostatic images, comprising toner particles containing a binder resin, carbon black, an azo iron compound represented by formula (1) below, and an oxycarboxylic acid metal compound, wherein the toner particles have been prepared by:

preparing a polymerizable monomer composition comprising a polymerizable monomer, carbon black, an azo iron compound represented by the formula (1) below and an oxycarboxylic acid metal compound, dispersing the polymerizable monomer composition in an aqueous medium to form particles of the polymerizable monomer composition, and polymerizing the polymerizable monomer in the particles to form toner particles comprising the polymerized monomer as the binder resin;

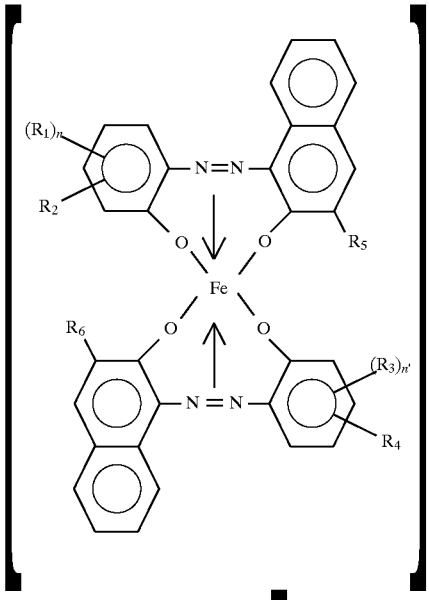

(1)

wherein $R_1$ and $R_3$ independently denote hydrogen, $C_{1-18}$ alkyl, $C_{2-18}$ alkenyl, sulfonamido group, mesyl, sulfonic acid group, hydroxy, $C_{1-18}$ alkoxy, acetylamino, benzoylamino, halogen atom, or —O.CO.$R_7$ wherein $R_7$ is alkyl or aryl, n and n' are integers of 1–3, $R_2$ and $R_4$ independently denote hydrogen or nitro, $R_5$ and $R_6$ independently denote hydrogen, halogen, nitro, carboxy, $C_{1-18}$ alkyl, $C_{2-18}$ alkenyl, $C_{7-18}$ aralkyl, $C_{1-18}$ alkoxy, $C_{6-18}$ aryl, —O.CO.$R_7$ wherein $R_7$ is $C_{1-18}$ alkyl or $C_{6-18}$ aryl, or

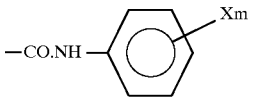

wherein m is an integer of 1–3 and X denotes hydrogen, lower alkyl, lower alkoxy, nitro or halogen; and $A^{\oplus}$ denotes $H^+$, $Na^+$, $K^+$, $NH_4^+$ or a mixture of these ions.

2. The toner according to claim 1, wherein the azo iron compound is represented by formula (2) below:

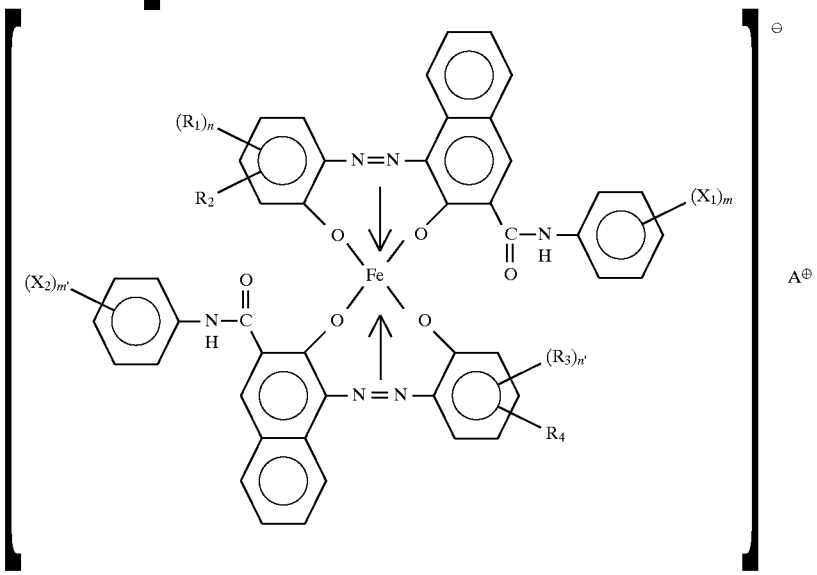

(2)

wherein $R_1$–$R_4$, n, n' and $A^{\oplus}$ are the same as in the formula (1); $X_1$ and $X_2$ independently denote hydrogen, lower alkyl, lower alkoxy, nitro or halogen; and m and m' are integers of 1–3.

3. The toner according to claim 1, wherein the oxycarboxylic acid metal compound is an aromatic oxycarboxylic acid metal compound.

4. The toner according to claim 1, wherein the oxycarboxylic acid metal compound comprises aluminum or zinc as the metal.

5. The toner according to claim 1, wherein the oxycarboxylic acid metal compound is a member selected from the group consisting of alkylsalicylic acid aluminum compounds, alkylsalicylic acid zinc compounds, dialkylsalicylic acid aluminum compounds and dialkylsalicylic acid zinc compounds, wherein each alkyl represents an alkyl group having at most 5 carbon atoms.

6. The toner according to claim 1, wherein the oxycarboxylic acid metal compound is 3,5-di-tetrabutylsalicylic acid aluminum compound or 3,5-di-tetrabutylsalicylic acid zinc compound.

7. The toner according to claim 1, wherein the toner is a non-magnetic toner.

8. The toner according to claim 1, wherein the binder resin comprises a resin selected from the group consisting of styrene polymers, styrene-acrylic copolymers and styrene-methacrylic copolymers.

9. The toner according to claim 1, wherein the toner particles further contain a polar resin.

10. The toner according to claim 9, wherein the polar resin comprises polyester or polycarbonate.

11. The toner according to claim 1, wherein the toner has a shape providing shape factors SF-1 of 100–140, and SF-2 of 100–120.

12. The toner according to claim 1, wherein the toner has a weight-average particle size of 3–10 $\mu$m.

13. The toner according to claim 1, wherein the toner has a weight-average particle size of 3–8 $\mu$m.

14. The toner according to claim 1, wherein the azo iron compound is added in 0.1–8 wt. parts per 100 wt. parts of the binder resin.

15. The toner according to claim 1, wherein the azo iron compound is added in 0.1–6 wt. parts per 100 wt. parts of the binder resin.

16. The toner according to claim 1, wherein the oxycarboxylic acid metal compound is added in 0.1–10 wt. parts per 100 wt. parts of the binder resin.

17. The toner according to claim 1, wherein the oxycarboxylic acid metal compound is added in 0.1–6 wt. parts per 100 wt. parts of the binder resin.

18. The toner according to claim 1, wherein the azo iron compound is added in A wt. parts and the oxycarboxylic acid metal compound is added in B wt. parts, satisfying: $0.1 \leqq A/B \leqq 20$.

19. The toner according to claim 1, wherein the carbon black is added in 1–20 wt. parts per 100 wt. parts of the binder resin.

20. A process for producing a toner for developing electrostatic images, comprising the steps of:

(i) preparing a polymerizable monomer composition comprising a polymerizable monomer, carbon black, an azo iron compound represented by formula (1) below and an oxycarboxylic acid metal compound, (ii) dispersing the polymerizable monomer composition in an aqueous medium to form particles of the polymerizable monomer composition, and (iii) polymerizing the polymerizable monomer in the particles to form toner particles comprising the polymerized monomer as the binder resin;

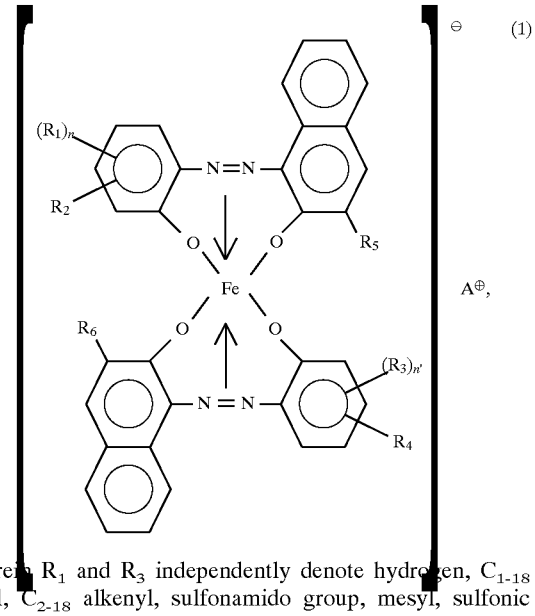

(1)

wherein $R_1$ and $R_3$ independently denote hydrogen, $C_{1-18}$ alkyl, $C_{2-18}$ alkenyl, sulfonamido group, mesyl, sulfonic acid group, hydroxy, $C_{1-18}$ alkoxy, acetylamino, benzoylamino, halogen atom, or —O.CO.$R_7$ wherein $R_7$ is alkyl or aryl, n and n' are integers of 1–3, $R_2$ and $R_4$ independently denote hydrogen or nitro, $R_5$ and $R_6$ independently denote hydrogen, halogen, nitro, carboxy, $C_{1-18}$ alkyl, $C_{2-18}$ alkenyl, $C_{7-18}$ aralkyl, $C_{1-18}$ alkoxy, $C_{6-18}$ aryl, —O.CO.$R_7$ wherein $R_7$ is $C_{1-18}$ alkyl or $C_{6-18}$ aryl, or

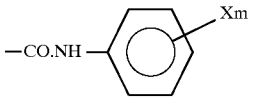

wherein m is an integer of 1–3 and X denotes hydrogen, lower alkyl, lower alkoxy, nitro or halogen; and $A^{\oplus}$ denotes $H^+$, $Na^+$, $K^+$, $NH_4^+$ or a mixture of these ions.

21. The process according to claim 20, wherein the azo iron compound is represented by formula (2) below:

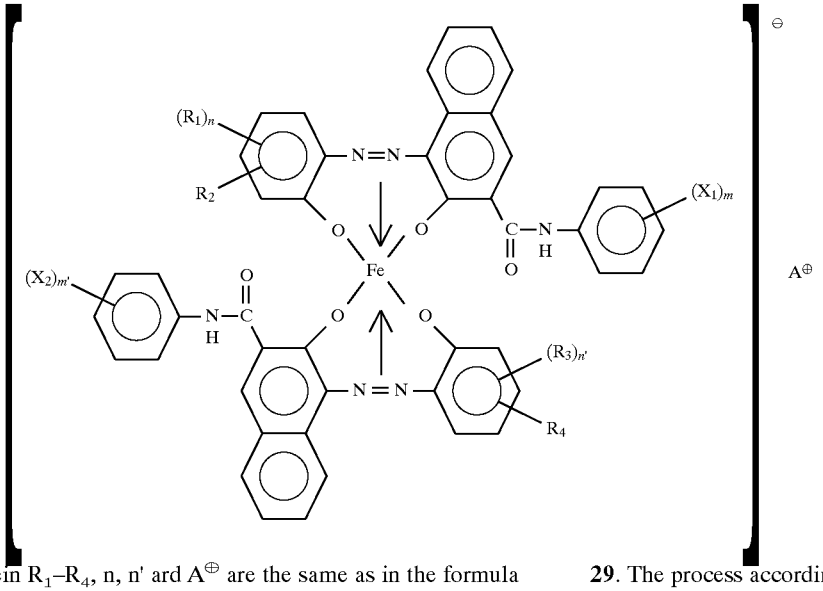

(2)

wherein $R_1$–$R_4$, n, n' ard $A^{\oplus}$ are the same as in the formula (1); $X_1$ and $X_2$ independently denote hydrogen, lower alkyl, lower alkoxy, nitro or halogen; and m and m' are integers of 1–3.

22. The process according to claim 20, wherein the oxycarboxylic acid metal compound is an aromatic oxycarboxylic acid metal compound.

23. The process according to claim 20, wherein the oxycarboxylic acid metal compound comprises aluminum or zinc as the metal.

24. The process according to claim 20, wherein the oxycarboxylic acid metal compound is a member selected from the group consisting of alkylsalicylic acid aluminum compounds, alkylsalicylic acid zinc compounds, dialkylsalicylic acid aluminum compounds and dialkylsalicylic acid zinc compounds, wherein each alkyl represents an alkyl group having at most 5 carbon atoms.

25. The process according to claim 20, wherein the oxycarboxylic acid metal compound is 3,5-di-tetrabutylsalicylic acid aluminum compound or 3,5-di-tetrabutylsalicylic acid zinc compound.

26. The process according to claim 20, wherein the toner is a non-magnetic toner.

27. The process according to claim 20, wherein the polymerizable monomer comprises at least one monomer selected from the group consisting of styrene monomers, acrylate ester monomers, and methacrylate ester monomers.

28. The process according to claim 20, wherein the polymerizable monomer composition further contains a polar resin.

29. The process according to claim 28, wherein the polar resin comprises polyester or polycarbonate.

30. The process according to claim 20, wherein the toner has a shape providing shape factors SF-1 of 100–140, and SF-2 of 100–120.

31. The process according to claim 20, wherein the toner has a weight-average particle size of 3–10 $\mu$m.

32. The process according to claim 20, wherein the toner has a weight-average particle size of 3–8 $\mu$m.

33. The process according to claim 20, wherein the azo iron compound is added in 0.1–8 wt. parts per 100 wt. parts of the poymerizable monomer.

34. The process according to claim 20, wherein the azo iron compound is added in 0.1–6 wt. parts per 100 wt. parts of the polymerizable monomer.

35. The process according to claim 20, wherein the oxycarboxylic acid metal compound is added in 0.1–10 wt. parts per 100 wt:. parts of the polymerizable monomer.

36. The process according to claim 20, wherein the oxycarboxylic acid metal compound is added in 0.1–6 wt. parts per 100 wt. parts of the polymerizable monomer.

37. The process according to claim 20, wherein the azo iron compound is added in A wt. parts and the oxycarboxylic acid metal compound is added in B wt. parts, satisfying: $0.1 \leqq A/B \leqq 20$.

38. The process according to claim 20, wherein the carbon black is added in 1–20 wt. parts per 100 wt. parts of the polymerizable monomer.

* * * * *

UNITED STATES PATENT AND TRADEMARK OFFICE

CERTIFICATE OF CORRECTION

PATENT NO. : 5,856,055

DATED : January ,5 1999

INVENTOR(S) : TOSHIYUKI UGAI ET AL.

It is certified that error appears in the above-identified patent and that said Letters Patent is hereby corrected as shown below:

On the title page item,

[57] ABSTRACT

Line 7, "effects" should read --effect--.

COLUMN 1

Line 51, "and" should read --are--.

COLUMN 4

Line 6, "above mentioned" should read --above-mentioned--.

COLUMN 8

Line 26, "re" should read --are--.

COLUMN 13

Line 63, "SF-2=[(PERI)$^2$/AREA]x(1/4π)100,]" should read --SF-2=[(PERI)$^2$/AREA]x(1/4π)·100,--.

UNITED STATES PATENT AND TRADEMARK OFFICE

CERTIFICATE OF CORRECTION

PATENT NO. : 5,856,055

DATED : January ,5 1999

INVENTOR(S) : TOSHIYUKI UGAI ET AL.

It is certified that error appears in the above-identified patent and that said Letters Patent is hereby corrected as shown below:

COLUMN 14

Line 60, "Size" should read --size--.

COLUMN 15

Line 27, "liable" should read --liable to--.
Line 40, "JP-A 53-61842;" should read --JP-A 59-61842;--.
Line 53, "SF-i" should read --SF-1--.

COLUMN 17

Line 2, "(SBET)" should read --($S_{BET}$)--.
Line 5, "article" should read --particle--.

COLUMN 18

Line 12, "follow ing" should read --following--.

COLUMN 20

Line 11, "10.0μ/" should read --10.0μm--.

UNITED STATES PATENT AND TRADEMARK OFFICE

CERTIFICATE OF CORRECTION

PATENT NO. : 5,856,055

DATED : January ,5 1999

INVENTOR(S) : TOSHIYUKI UGAI ET AL.

It is certified that error appears in the above-identified patent and that said Letters Patent is hereby corrected as shown below:

COLUMN 21

Line 13, "on-to" should read --onto--.
Table, "parts(s)" (all six occurrences in table) should Read --part(s)--.

COLUMN 22

Line 18, "hour" should read --hours--.
Line 21, "hydrochoric" should read --hydrochloric--.
Line 33, "(SBET)" should read --($S_{BET}$)--.
Line 55, "hereby" should read --whereby--.

COLUMN 23

Line 1, "The above-prepared master batch" should be deleted.
Table 3, "dispersion liquid" should read --The above-prepared master batch dispersion liquid--.

UNITED STATES PATENT AND TRADEMARK OFFICE

CERTIFICATE OF CORRECTION

PATENT NO. : 5,856,055

DATED : January ,5 1999

INVENTOR(S) : TOSHIYUKI UGAI ET AL.

It is certified that error appears in the above-identified patent and that said Letters Patent is hereby corrected as shown below:

COLUMN 24

Line 29, "blow" should read --below--.
Line 49, "while" should read --white--.
Line 54, "A:0.≤5%" should read --"A:0.≤0.5%--.
Line 66, "result" should read --results--.

COLUMN 26

Line 35, "2-hydrdxynaphthalene-3-carboxylic" should read --2-hydroxynaphthalene-3-carboxylic--.

COLUMN 32

Line 38, "benzoylaminc," should read --benzoylamino,--.

Signed and Sealed this
Fourth Day of January, 2000

*Attest:*

*Attesting Officer*

*Acting Commissioner of Patents and Trademarks*